US005732673A

United States Patent [19]

Mandella

[11] Patent Number: 5,732,673

[45] Date of Patent: Mar. 31, 1998

[54] TRIPLE-CRANKSHAFT VARIABLE STROKE ENGINE

[76] Inventor: Michael J. Mandella, 10193 Parkwood Dr. #2, Cupertino, Calif. 95014

[21] Appl. No.: 872,012

[22] Filed: Jun. 9, 1997

Related U.S. Application Data

[62] Division of Ser. No. 745,889, Nov. 8, 1996, Pat. No. 5,680,840.

[51] Int. Cl.[6] ..... F02B 75/32

[52] U.S. Cl. ..... 123/197.4; 123/786; 123/48 B

[58] Field of Search ..... 123/48 B, 78 R, 123/78 E, 78 F, 197.4, 197.3

[56] References Cited

U.S. PATENT DOCUMENTS

| | | | |
|---|---|---|---|
| 4,449,494 | 5/1984 | Beaudoin | 123/197.4 |
| 4,690,113 | 9/1987 | Deland | 123/78 E |
| 5,077,976 | 1/1992 | Pusic et al. | 123/197.3 |
| 5,216,927 | 6/1993 | Mandelia | 123/197.4 |
| 5,435,232 | 7/1995 | Hammerton | 123/197.4 |

*Primary Examiner*—Marguerite McMahon
*Attorney, Agent, or Firm*—Lumen Intellectual Property Services

[57] ABSTRACT

A variable stroke engine includes first and second pistons mounted in respective cylinders for reciprocal linear movement. The engine also includes first, second, and third parallel crankshafts. A first connecting assembly connects the first piston to the first and second crankshafts. A second connecting assembly connects the second piston to the second and third crankshafts. Each connecting assembly includes first and second connecting rods arranged in a crossing relationship with each other. A first set of synchronizing gears establishes co-rotation of the first and second crankshafts and synchronizes a first angular phase relationship between the first and second crankshafts. A second set of synchronizing gears establishes co-rotation of the second and third crankshafts and synchronizes a second angular phase relationship between the second and third crankshafts. A phase adjustment mechanism is connected to the first and second sets of synchronizing gears to adjust the first and second angular phase relationships, thereby varying the stroke of each piston.

9 Claims, 11 Drawing Sheets

TRIPLE-CRANKSHAFT VARIABLE STROKE ENGINE

RELATED APPLICATION INFORMATION

This application is a divisional application of application Ser. No. 08/745,889 filed Nov. 8, 1996, now U.S. Pat. No. 5,680,840.

FIELD OF THE INVENTION

The present invention relates generally to the field of variable stroke engines, and in particular to a variable stroke engine having multiple, co-rotating crankshafts and a mechanism for selectively adjusting the angular phase relationship between the crankshafts, thereby varying the amplitude of the piston stroke and the compression ratio of the engine.

DESCRIPTION OF PRIOR ART

Many of the operating parameters of a conventional piston engine are fixed at the time of manufacture. In particular, the length of the piston stroke and the corresponding compression ratio of the engine are usually set to allow reasonably good performance of the engine over its full range of operation. However, the piston stroke and compression ratio are rarely optimal at any specific operating point in the range. Other engines have a fixed compression ratio selected to favor only one or two narrow points of operation so that the efficiency of these engines is seriously deficient outside of these points.

For example, a fixed compression ratio engine designed to operate at maximum power levels operates inefficiently and emits higher levels of pollution at lower power levels. Additionally, a fixed compression ratio engine is limited in the types of fuel that it may burn. In contrast, a variable stroke engine having a correspondingly variable compression ratio would allow engine performance to be optimized and polluting emission levels to be minimized for various power output levels, types of fuel burned, and other specific operating requirements of the engine.

Many types of variable stroke mechanisms have been proposed to vary the piston stroke and corresponding compression ratio of an engine. For example, U.S. Pat. No. 4,255,989 issued to Dinelli on Mar. 17, 1981 describes a mechanism for transferring a rotary drive from two parallel shafts to a reciprocal member having a variable amplitude stroke. Each shaft has a disc with a peripheral pin. Each pin is connected to a rocker by a respective connecting rod assembly that includes three connecting rods connected pairwise and a slider for binding the motion of the center rod. The rocker is pivotally connected at its center to the reciprocal member. The amplitude of the reciprocal member may be varied by changing the phase relationship between the parallel shafts using a differential gear box.

Although the mechanism described by Dinelli does provide a variable stroke length, it has several disadvantages which preclude its widespread use. First the geometry of the complicated connecting rod and slider assembly is generally unsuitable for the space constraints of most reciprocating piston engines. Second, the assembly is not sufficiently robust to handle the high loading conditions required in most reciprocating piston engines.

Another variable stroke mechanism is disclosed in U.S. Pat. No. 4,270,495 issued to Freudenstein et. al on Jun. 2, 1981. Freudenstein describes a variable displacement piston engine having a pair of pistons reciprocal in respective parallel cylinders. A stroke control actuator located between the cylinders supports an oscillating link having oppositely extending arms. Each arm is connected by a respective connecting rod to one of the pistons. The oscillating link is connected to a rocker which is in turn connected to an eccentric crank pin of a crankshaft. The stroke of the pistons may be adjusted by varying the height of the stroke control actuator.

U.S. Pat. No. 5,058,536 issued to Johnston on Oct. 22, 1991 describes a variable cycle engine having a pair of opposed pistons in an engine block. Each piston is connected to a respective crankshaft by a connecting rod. A gear train synchronizes the speed and angular phase relationship between the crankshafts. A timing actuator is engaged with the crankshafts to permit selective adjustment of the headspace between the opposed pistons.

Although the mechanisms described by Freudenstein and Johnston do allow for variation in piston stroke, they do not provide for a balanceable engine. The connecting assemblies described have only one connecting rod connected to each piston, resulting in unbalanced side forces being applied to each piston during its reciprocal movement in its respective cylinder. These side forces increase friction and wear between the piston and cylinder and decrease overall engine efficiency.

U.S. Pat. No. 5,216,927 issued to applicant on Jun. 8, 1993 presents a balanceable engine having a connecting assembly which substantially reduces the unbalanced side forces experienced by a piston as it reciprocates in a cylinder. However, the applicant's previously disclosed engine has no mechanism for varying the piston stroke, nor is it directed at providing a variable stroke engine having a correspondingly variable compression ratio.

OBJECTS AND ADVANTAGES OF THE INVENTION

In view of the above, it is an object of the present invention to provide a variable stroke engine having a correspondingly variable compression ratio. It is another object of the invention to provide a connecting assembly for the variable stroke engine which significantly reduces the side forces and frictional forces associated with the reciprocal movement of a piston in a cylinder.

These and other objects and advantages of the invention will become more apparent after consideration of the ensuing description and the accompanying drawings.

SUMMARY

The invention presents a variable stroke engine having first and second pistons. Each piston is slidably mounted in a respective cylinder for reciprocal linear movement therein. First, second, and third crankshafts are mounted in the engine for rotational motion about respective first, second, and third rotational axes. The rotational axes are preferably parallel to each other. The first crankshaft has a first crank pin, the second crankshaft has a second crank pin, and the third crankshaft has a third crank pin.

A first connecting assembly connects the first piston to the first and second crankshafts. The first connecting assembly includes a first oscillating member pivotally connected to the first piston at a first connection. The first connecting assembly further includes first and second connecting rods rotatably connected to the first and second crank pins, respectively. The first and second connecting rods are further rotatably connected to the first oscillating member at respective second and third connections. The second and third connections are offset from the first connection and offset from each other such that the first and second connecting rods are arranged in a crossing relationship with each other.

A second connecting assembly connects the second piston to the second and third crankshafts. The second connecting assembly includes a second oscillating member pivotally connected to the second piston at a fourth connection. The second connecting assembly further includes third and fourth connecting rods rotatably connected to the second and third crank pins, respectively. The third and fourth connecting rods are further rotatably connected to the second oscillating member at respective fifth and sixth connections. The fifth and sixth connections are offset from the fourth connection and offset from each other such that the third and fourth connecting rods are arranged in a crossing relationship with each other.

The engine further includes a first set of synchronizing gears for establishing co-rotation of the first and second crankshafts and for synchronizing a first angular phase relationship between the first and second crankshafts. A second set of synchronizing gears establishes co-rotation of the second and third crankshafts and synchronizes a second angular phase relationship between the second and third crankshafts. A phase adjustment mechanism is connected to the first and second sets of synchronizing gears to adjust the first and second angular phase relationships, thereby varying the amplitude of the reciprocal linear movement of each piston.

DESCRIPTION

Figure 1:
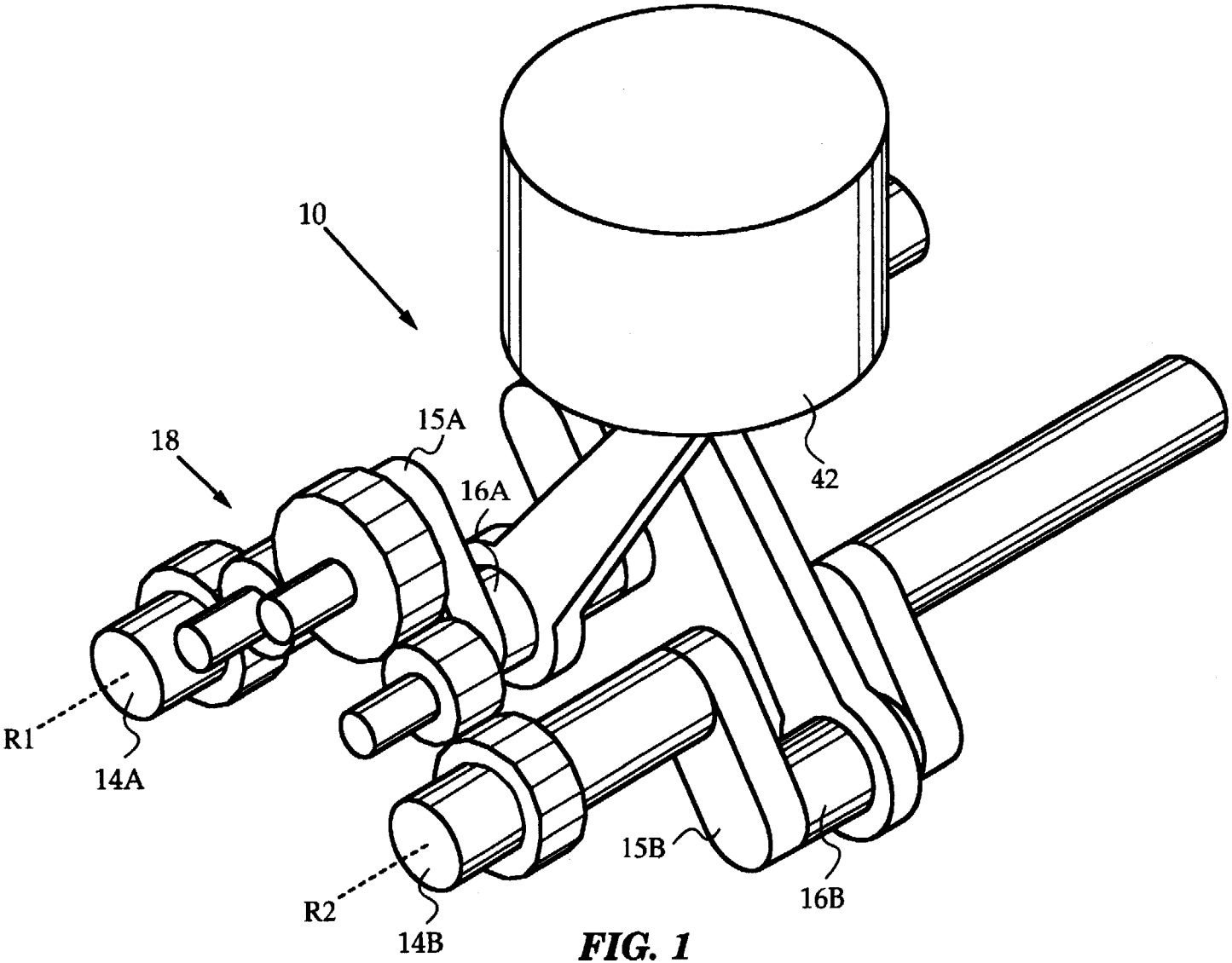
FIG. 1 is a three dimensional view of a dual crankshaft variable stroke engine according to the invention.
Figure 2:
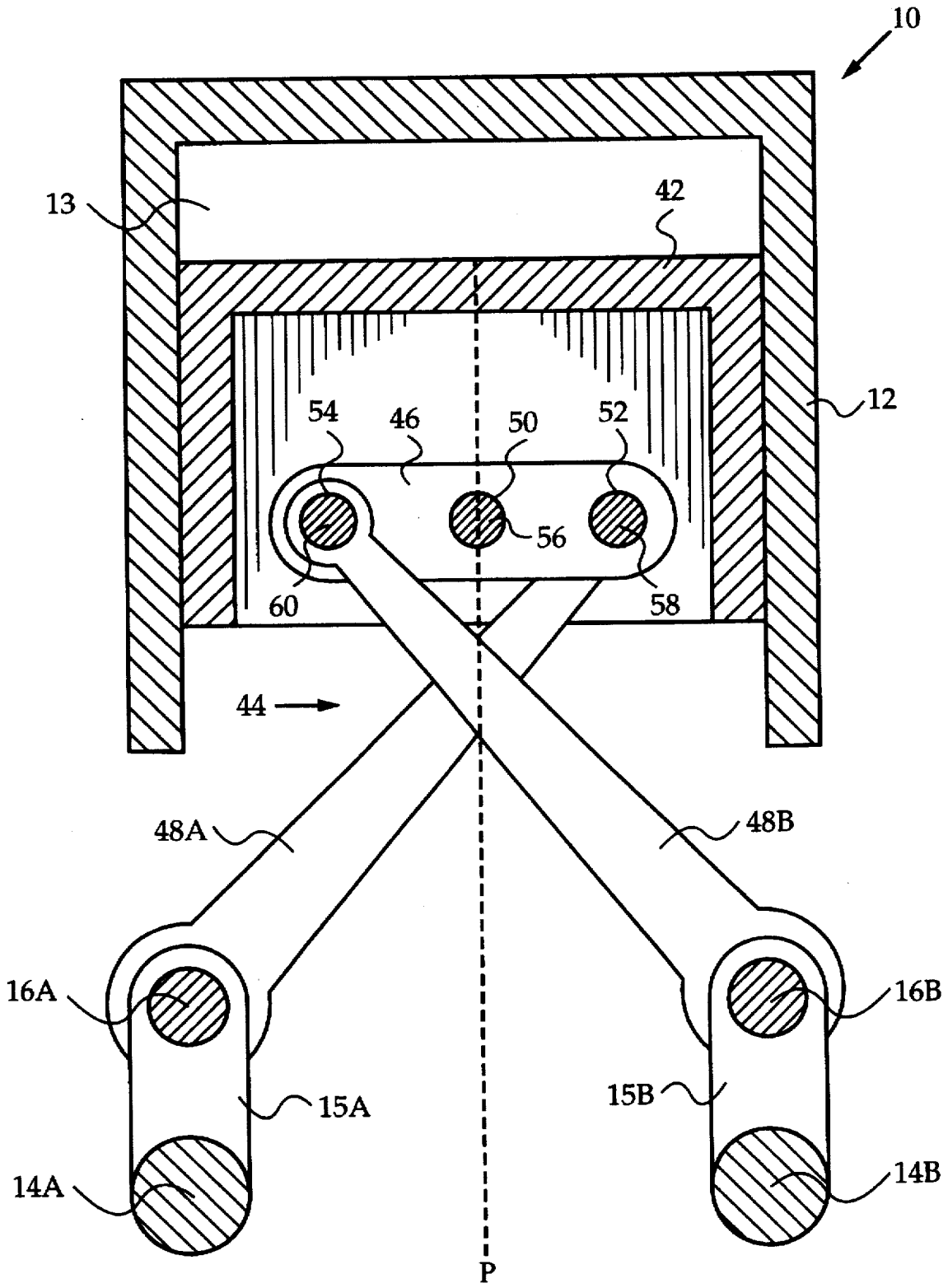
FIG. 2 is a schematic front view of the engine of FIG. 1.
Figure 3:
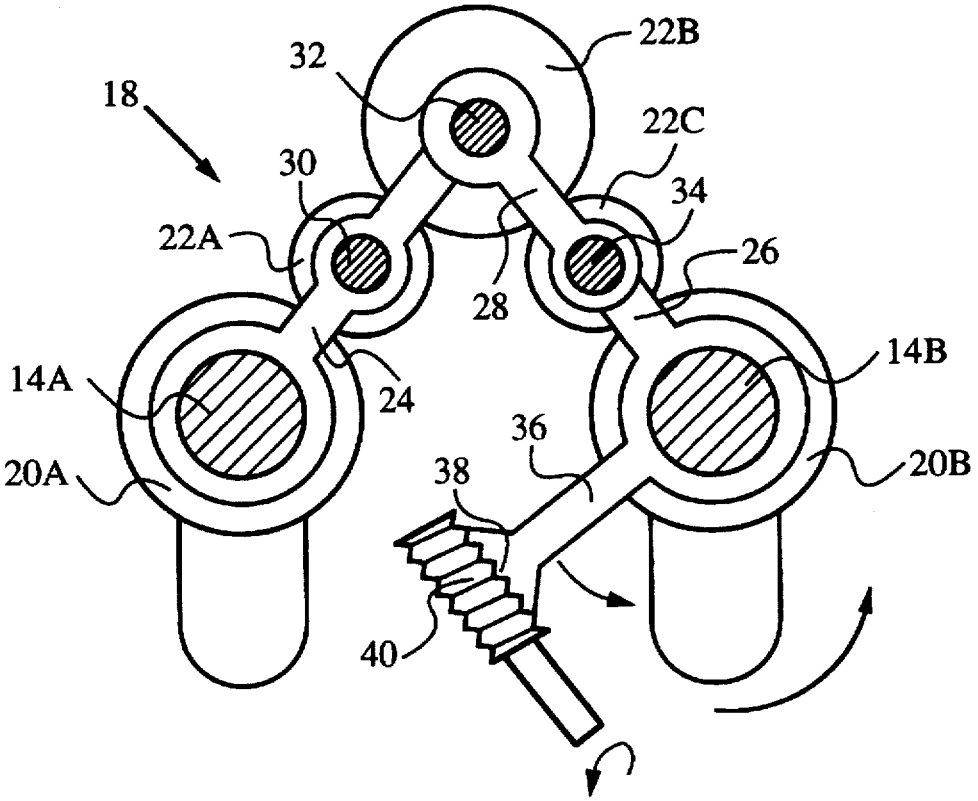
FIGS. 3–4 are schematic front views of synchronizing gears and a phase adjustment mechanism for the engine of FIG. 1.

A preferred embodiment of the invention is illustrated in FIGS. 1–3. FIG. 1 shows a three dimensional view of a dual crankshaft variable stroke engine 10. Engine 10 includes a first crankshaft 14A mounted for rotational motion about a first rotational axis R1. Crankshaft 14A has a first crank arm 15A and a first crank pin 16A connected to crank arm 15A. Engine 10 also includes a second crankshaft 14B mounted for rotational motion about a second rotational axis R2. In the preferred embodiment, rotational axes R1 and R2 are parallel to each other. Crankshaft 14B has a second crank arm 15B and a second crank pin 16B connected to crank arm 15B. Engine 10 further includes a gear assembly 18 for establishing co-rotation of crankshafts 14A and 14B and for synchronizing an angular phase relationship Φ between crankshafts 14A and 14B.

FIG. 3 shows a schematic front view of gear assembly 18. Assembly 18 includes a first crank gear 20A mounted coaxially with crankshaft 14A. Crank gear 20A is fixedly attached at its center to crankshaft 14A for mutual rotation of crank gear 20A with crankshaft 14A. Assembly 18 also includes a second crank gear 20B mounted coaxially with crankshaft 14B. Crank gear 20B is fixedly attached at its center to crankshaft 14B for mutual rotation of crank gear 20B with crankshaft 14B. Assembly 18 further includes a first synchronizing gear 22A, a second synchronizing gear 22B, and a third synchronizing gear 22C. Synchronizing gears 22A, 22B, and 22C couple crank gears 20A and 20B.

A phase adjustment mechanism is connected to gear assembly 18 for adjusting angular phase relationship Φ between crankshafts 14A and 14B. In the preferred embodiment, the phase adjustment mechanism includes a first linking member 24, a second linking member 26, a third linking member 28, a lever 36, and a worm gear 40. One end of first linking member 24 is pivotally connected to crankshaft 14A for pivotal movement of member 24 about the rotational axis of crankshaft 14A. Synchronizing gear 22B is rotatably connected to the other end of linking member 24 by a pin 32. A pin 30 rotatably connects synchronizing gear 22A to linking member 24 between crank gear 20A and synchronizing gear 22B such that synchronizing gear 22A couples crank gear 20A and synchronizing gear 22B.

Second linking member 26 is pivotally connected at one end to crankshaft 14B for pivotal movement about the rotational axis of crankshaft 14B. Synchronizing gear 22C is rotatably connected to the other end of linking member 26 by a pin 34 such that synchronizing gear 22C engages crank gear 20B. Third linking member 28 is pivotally connected at one end to first linking member 24 by pin 32. The other end of linking member 28 is pivotally connected to linking member 26 by pin 34. Linking member 28 is designed to hold synchronizing gears 22B and 22C in engagement such that synchronizing gear 22C couples synchronizing gear 22B and crank gear 20B.

Lever 36 and worm gear 40 provide an actuator for pivoting linking member 26 about the rotational axis of crankshaft 14B, thereby changing angular phase relationship Φ between crankshafts 14A and 14B. Lever 36 has a first end fixably attached to linking member 26 and a second end having external teeth 38. Worm gear 40 is in meshing engagement with external teeth 38 such that rotation of worm gear 40 pivots the second end of lever 36 about the first end of lever 36, thus pivoting linking member 26 about the rotational axis of crankshaft 14B.

FIG. 2 shows a schematic front view of engine 10 with each crank arm 15A and 15B in a top dead center position. Engine 10 includes a cylinder 12 which is part of an engine block. A piston 42 is slidably mounted in cylinder 12 for reciprocal linear movement in cylinder 12 along a reciprocal axis P. Reciprocal axis P preferably coincides with the longitudinal axis of cylinder 12. In the preferred embodiment, crankshafts 14A and 14B are positioned equidistantly from axis P.

Piston 42 is connected to crank pins 16A and 16B by a connecting assembly 44. Assembly 44 includes an oscillating member 46 pivotally connected to piston 42 at a first connection 50 by a pin 56. In the preferred embodiment, the longitudinal axis of pin 56 is perpendicular to and intersects reciprocal axis P. Oscillating member 46 is thus connected for pivotal movement about a pivot axis which is perpendicular to and intersects reciprocal axis P.

Assembly 44 also includes a first connecting rod 48A having one end rotatably connected to crank pin 16A. The other end of rod 48A is rotatably connected to oscillating member 46 at a second connection 52 by a pin 58. Assembly 44 further includes a second connecting rod 48B having one end rotatably connected to crank pin 16B. The other end of rod 48B is rotatably connected to oscillating member 46 at a third connection 54 by a pin 60. Second and third connections 52 and 54 are offset from first connection 50 and offset from each other such that connecting rods 48A and 48B are arranged in a crossing relationship with each other. In the preferred embodiment, connections 52 and 54 are positioned equidistantly from connection 50 on opposite sides of connection 50.

Cylinder 12 and piston 42 define a cylinder chamber 13. In the preferred embodiment, engine 10 is an internal combustion engine and chamber 13 is adapted to receive a combustible mixture of fuel for the combustion thereof. Specific techniques for combusting fuel in a cylinder chamber are well known in the art. In an alternative embodiment, engine 1O is a pneumatic engine which converts energy from compressed gas inside chamber 13 into rotational motion of crankshafts 14A and 14B. Specific techniques for introducing compressed gas into a cylinder chamber are also well known in the art.

The operation of the preferred embodiment is illustrated in FIGS. 3–6. FIGS. 5A–5D show piston 42 moving from a top dead center position to a bottom dead center position when crankshafts 14A and 14B are in phase. For purposes of illustration, crankshafts 14A and 14B are co-rotated 180 clockwise from FIG. 5A to FIG. 5D. Of course, the crankshafts may also be co-rotated counter-clockwise in alternative embodiments.

Figure 5A:
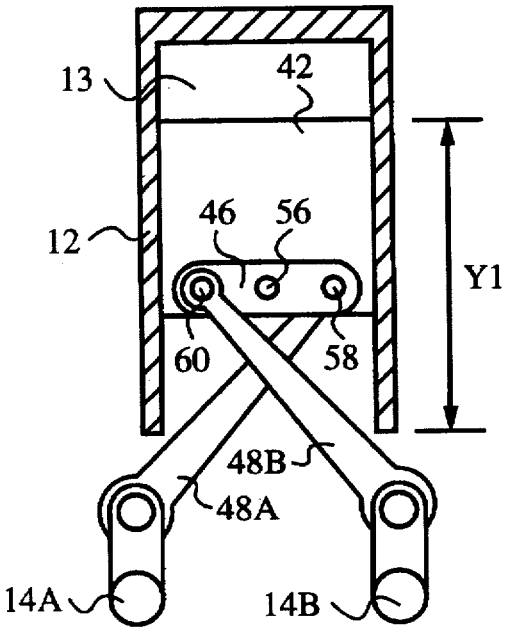
FIGS. 5A–5D show various positions of a piston, cylinder, and connecting rod assembly during the operation of the engine of FIG. 1 when the crankshafts are in phase.
Figure 5B:
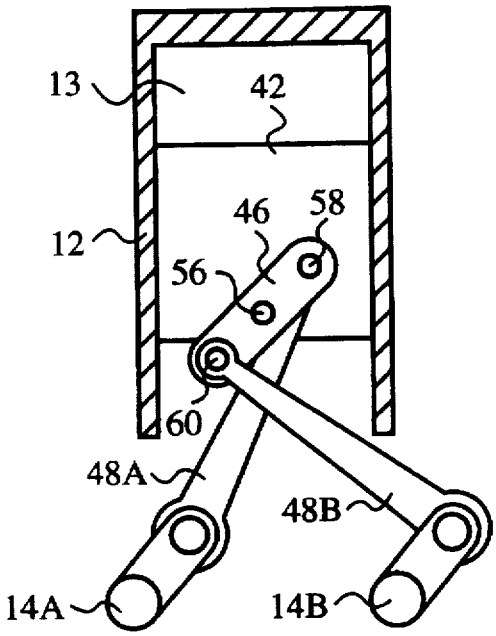
Figure 5C:
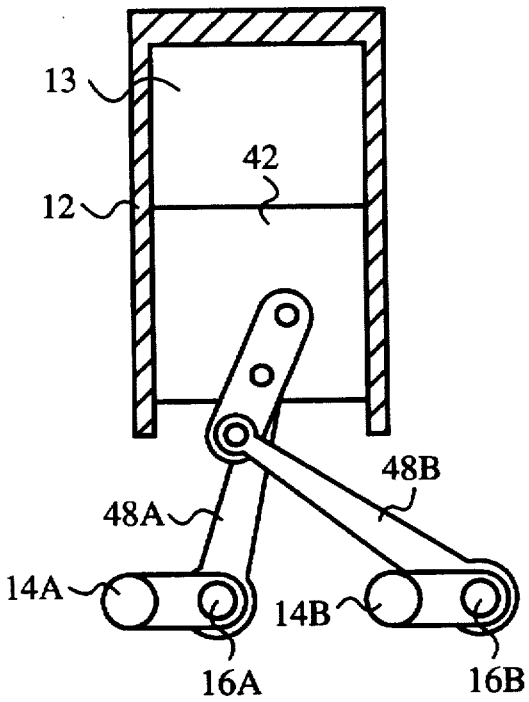

In FIG. 5A, piston 42 is at top dead center, extending to a height Y1 within cylinder 12. The clockwise rotation of crankshafts 14A and 14B causes connecting rod 48A to exert a pushing force on pin 58 and rod 48B to exert a pulling force on pin 60. The respective pushing and pulling forces pivot oscillating member 46 about pin 56, as shown in FIG. 5B. Meanwhile, combustion of fuel in chamber 13 creates compression in cylinder 12 which pushes piston 42 in a downward direction, as shown in FIG. 5C. As mentioned previously, the compression in cylinder 12 may also be created by introducing compressed gas into chamber 13.

Figure 5D:
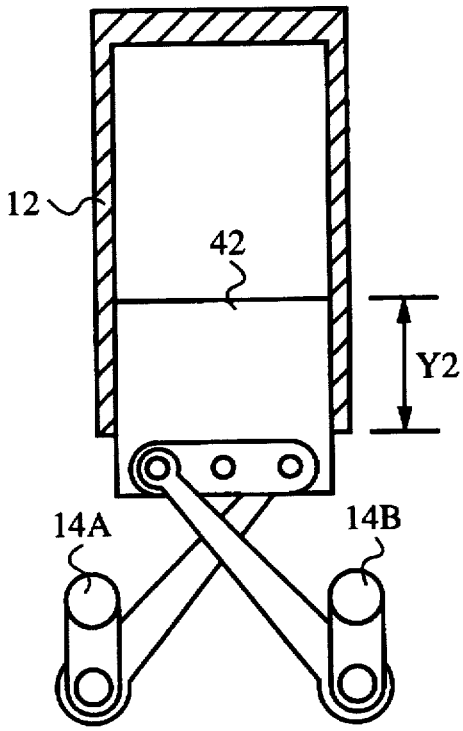

As piston 42 moves in a downward direction, rods 48A and 48B exert pushing forces on crank pins 16A and 16B, respectively, thus continuing the clockwise rotation of crankshafts 14A and 14B. FIG. 5D shows piston 42 at bottom dead center, with each crankshaft 14A and 14B rotated 180 from its initial angular position in FIG. 5A. Further rotation of the crankshafts returns piston 42 to top dead center, thus completing one cycle of the piston's reciprocal linear movement. As shown in FIG. 5D, piston 42 extends to a height Y2 in cylinder 12 at bottom dead center. Thus, when crankshafts 14A and 14B are in phase, the reciprocal linear movement of piston 42 has a first amplitude A, where amplitude A=Y1−Y2.

The amplitude of the reciprocal linear movement of piston 42 is varied by changing angular phase relationship Φ between crankshafts 14A and 14B. Phase relationship Φ is changed by rotating worm gear 40 in a counter clockwise direction, as shown in FIG. 3. Rotation of worm gear 40 causes lever 36 to pivot counter clockwise, thus pivoting second linking member 26 in a counter clockwise direction about the rotational axis of crankshaft 14B.

Figure 4:
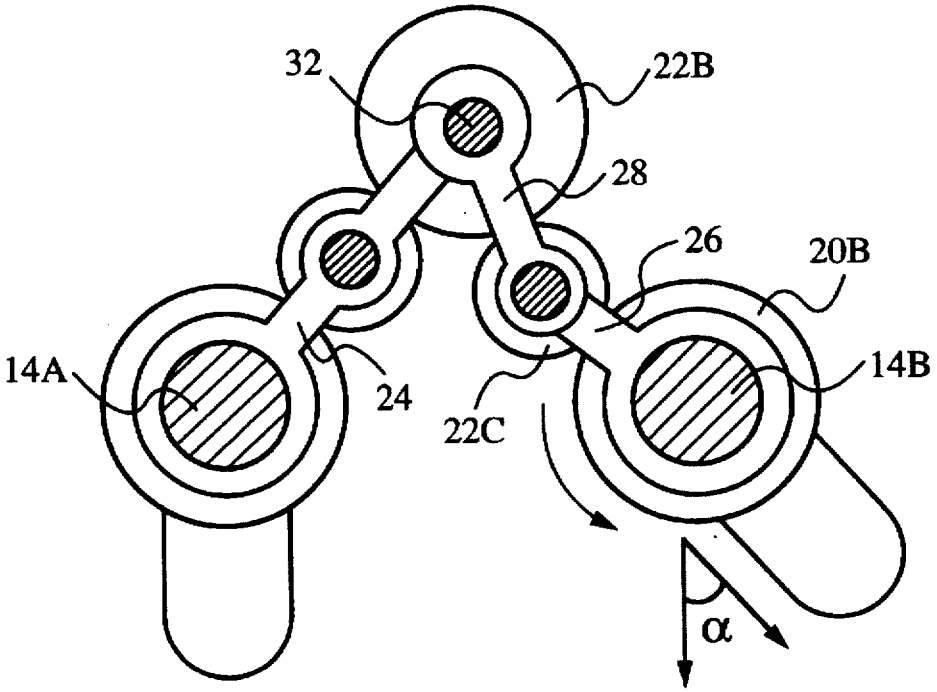

Referring to FIG. 4, the pivoting movement of member 26 moves third synchronizing gear 22C in the direction of crankshaft 14A. As gear 22C moves, first linking member 24 pivots clockwise about the rotational axis of crankshaft 14A and third linking member 28 pivots clockwise about pin 32 to hold third synchronizing gear 22C in engagement with second synchronizing gear 22B. The engagement of third synchronizing gear 22C with second synchronizing gear 22B and with second crank gear 20B causes third synchronizing gear 22C to rotate in a clockwise direction and second crank gear 20B to rotate in a counter clockwise direction.

Because crank gear 20B is attached to crankshaft 14B for mutual rotation therewith, crankshaft 14B also rotates in a counter clockwise direction, thus changing phase relationship Φ between crankshafts 14A and 14B by a phase angle α. Of course, phase angle α may be similarly decreased by clockwise rotation of worm gear 40. In the preferred embodiment, the phase adjustment mechanism is adapted to vary phase relationship Φ between crankshafts 14A and 14B by a phase angle in the range of 0 to 30. Of course, the phase adjustment mechanism may be adapted to vary phase relationship Φ through different ranges of phase angles in alternative embodiments.

Figure 6A:
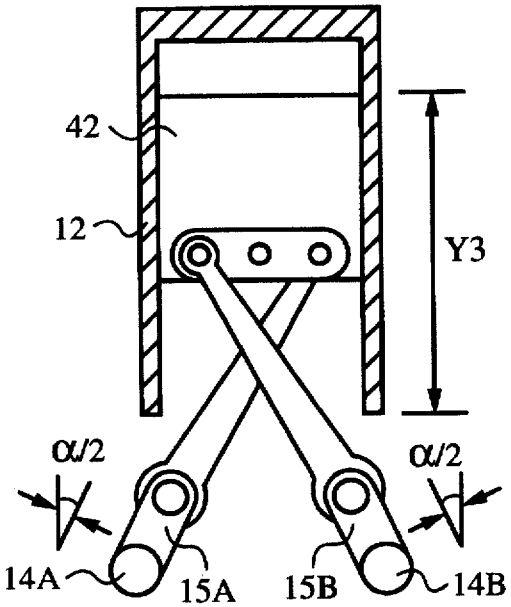
FIGS. 6A–6D show various positions of the piston, cylinder, and connecting rod assembly during the operation of the engine of FIG. 1 when the crankshafts differ in phase.
Figure 6B:
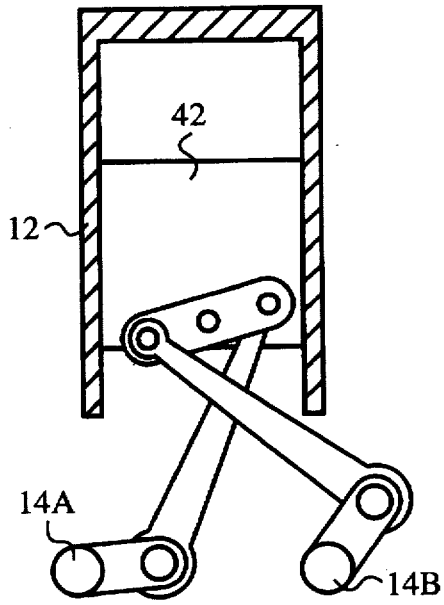
Figure 6C:
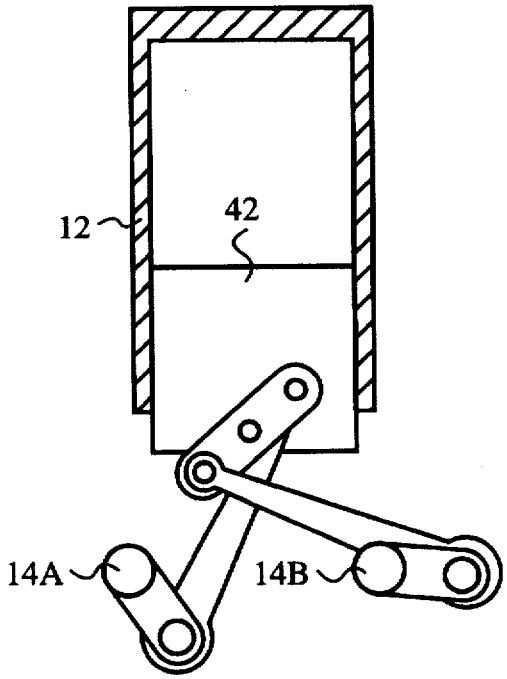

FIGS. 6A–6D show piston 42 moving from top dead center to bottom dead center when phase relationship Φ between crankshafts 14A and 14B differs by phase angle α. For purposes of illustration, crankshafts 14A and 14B are again co-rotated 180 clockwise from FIG. 6A to FIG. 6D. FIG. 6A shows piston 42 at top dead center extending to a height Y3 within cylinder 12. Due to the difference in phase between crankshafts 14A and 14B, crank arm 15A is angularly positioned α/2 degrees past top dead center and crank arm 15A is angularly positioned α/2 degrees before top dead center when piston 42 is at top dead center. The respective angular positions of crank arms 15A and 15B increase the top dead center height of piston 42 in cylinder 12, so that height Y3 is greater than height Y1.

Figure 6D:
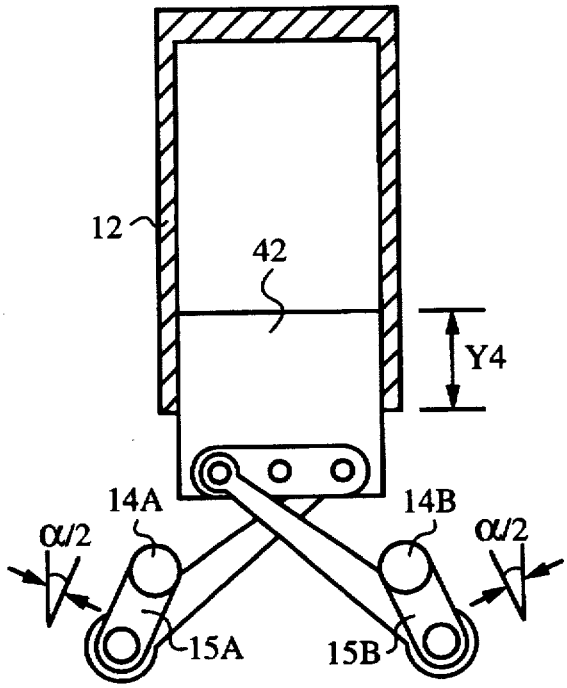

Similarly, FIG. 6D shows piston 42 at bottom dead center with crank arm 15A angularly positioned α/2 degrees past bottom dead center and crank arm 15B angularly positioned α/2 degrees before bottom dead center. The respective angular positions of crank arms 15A and 15B decrease the bottom dead center height of piston 42 in cylinder 12A. As a result, piston 42 now extends to a height Y4 which is less than height Y2. Thus, when crankshafts 14A and 14B differ in phase, the reciprocal linear movement of piston 42 has a second amplitude B, where amplitude B=Y3−Y4 and where amplitude B>amplitude A.

The amount by which amplitude B exceeds amplitude A for each value of phase angle α depends upon the geometry of the engine, and in particular the ratio of distances between various points in the engine. The distances between points are defined with reference to FIG. 2 as follows: C is the distance measured along crank arm 15A from the center of crankshaft 14A to the center of crank pin 16A. In the preferred embodiment, the distance measured along crank arm 15B from the center of crankshaft 14B to the center of crank pin 16B is also equal to distance C. D is the distance between second connection 52 and third connection 54. E is the distance between the respective centers of crankshafts 14A and 14B. F is the distance measured along rod 48A from the center of crank pin 16A to second connection 52. In the preferred embodiment, the distance measured along rod 48B from the center of crank pin 16B to third connection 54 is also equal to distance F.

The amplitude of the reciprocal linear movement of the piston may be found for various values of distances C, D, E, F, and phase angle α using the following mathematical relationship:

$$\text{amplitude} = (2C)\cos(\alpha/2) + \sqrt{F^2 - [D/2 + E/2 - C\sin(\alpha/2)]^2} - \sqrt{F^2 - [D/2 + E/2 + C\sin(\alpha/2)]^2}$$

The above relationship is useful when the ratios C:D:E:F and phase angle α are selected such that rods 48A and 48B maintain a crossing relationship throughout the piston's cycle of motion. For example, when the ratios C:D:E:F equal 2:2:4:5, the rods maintain a crossing relationship for values of phase angle α in the range of 0 to 90. Of course, many other ratios are also possible. In general, the ratios C:D:E:F preferably lie in the range of ratios given by C:D:E:F=(1 to 1.5):(1.5 to 3.5):4:(4.5 to 5.5). This range of ratios is intended to provide for engineering and/or fabrication tolerances.

Figure 7:
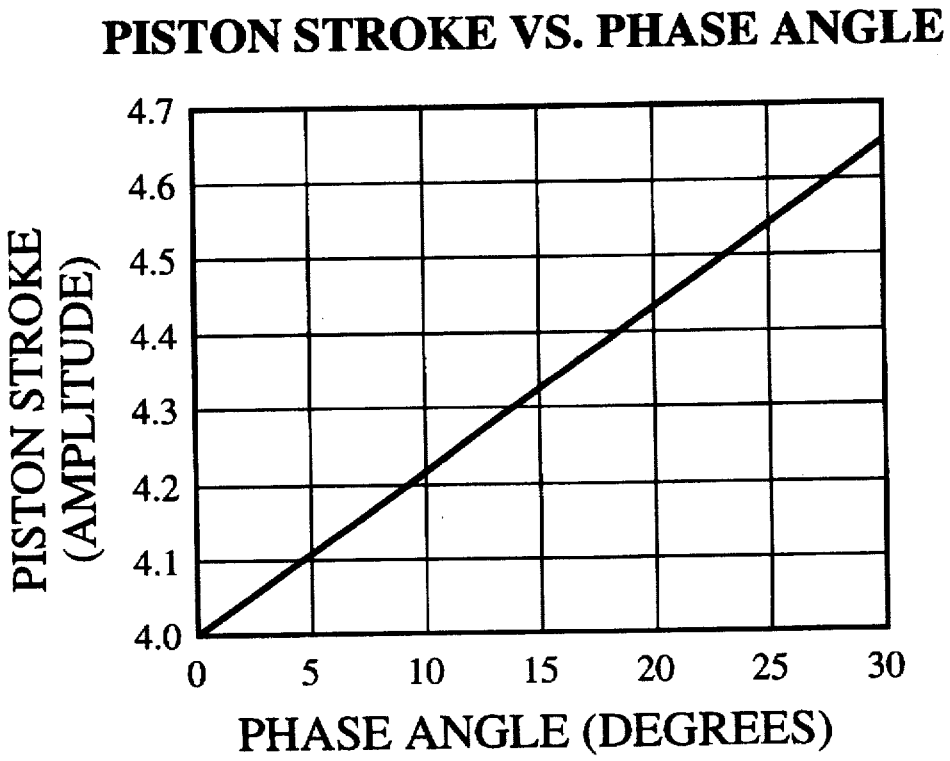
FIG. 7 is a graph showing the relationship between the difference in phase between the crankshafts and the amplitude of the piston stroke.
Figure 8:
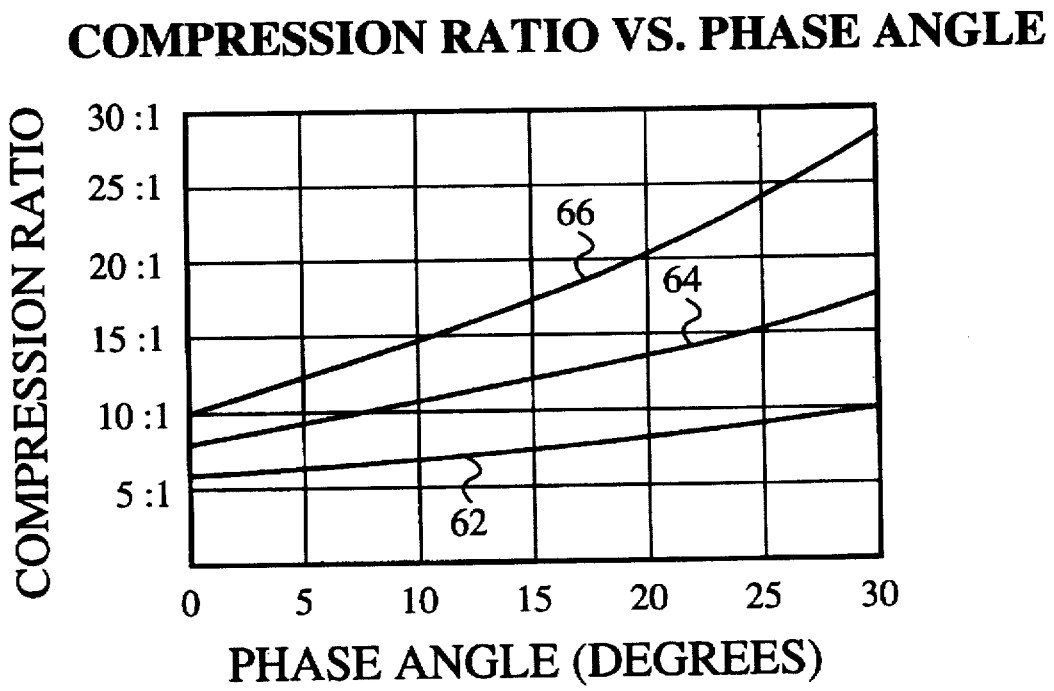
FIG. 8 is a graph showing the relationship between the difference in phase between the crankshafts and the compression ratio of the engine.

The relationship between phase angle α and the amplitude of the piston stroke has been analyzed when the ratios C:D:E:F equal 2:2:4:5. The results of the analysis are shown in FIGS. 7–8. As shown in FIG. 7, as phase angle α increases from 0 to 30, the amplitude of the piston stroke varies from first amplitude A when phase angle α equals 0 to second amplitude B when phase angle α equals 30, the ratio A:B equaling 4:4.65.

FIG. 8 shows how the compression ratio of the engine increases as phase angle α increases from 0 to 30 for three different initial compression ratios. Curve 62 shows how the compression ratio increases from an initial compression ratio of 6:1 when phase angle α equals 0 to a compression ratio of 10:1 when phase angle α equals 30. Curve 64 shows how the compression ratio increases from an initial compression ratio of 8:1 when phase angle α equals 0 to a compression ratio of 17:1 when phase angle α equals 30. Curve 66 shows how the compression ratio increases from an initial compression ratio of 10:1 when phase angle α equals 0 to a compression ratio of 28:1 when phase angle α equals 30.

Thus, one advantage of the engine of the preferred embodiment is that it allows large increases in compression ratio from relatively small adjustments in the angular phase relationship between the crankshafts. These increases in compression ratio allow the performance of the engine to be optimized and polluting emission levels to be minimized for various power output levels of the engine. Additionally, the engine may be adjusted to burn various types of fuels and adjusted to meet other specific operating requirements.

Another advantage of the engine described in the preferred embodiment is that it significantly reduces the side forces applied to the piston as the piston reciprocates in the cylinder. In a conventional engine, the piston is connected to the crankshafts by a connecting rod that exerts horizontal forces on the piston, thus causing friction between the piston and cylinder. In the engine of the preferred embodiment, the piston is connected to the crankshafts through an oscillating member which pivots to absorb the horizontal forces applied by the connecting rods. Consequently, the connecting assembly of the preferred embodiment provides an extremely balanceable engine and significantly reduces friction between the piston and cylinder.

The preferred embodiment has been described in relation to an engine which converts compression in the cylinder into rotational motion of the crankshafts. However, it is to be understood that the engine may also be used to perform the reverse operation. Accordingly, in an alternative embodiment, the engine converts rotational motion of the crankshafts into compressed gas inside the cylinder. In this alternative embodiment, the engine may be used as a gas compressor, pump, or similar compressing device.

Figure 13:
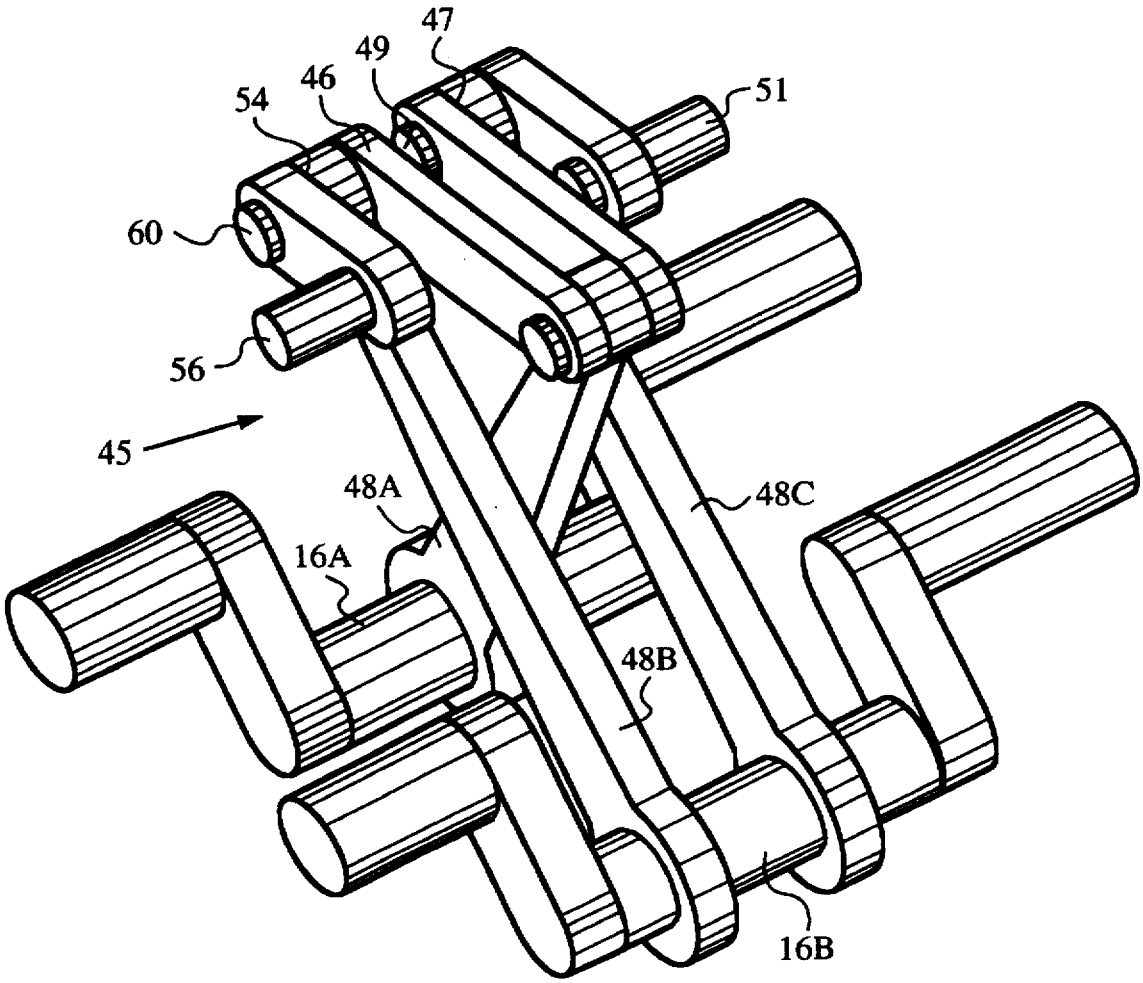
FIG. 13 is a three dimensional view of an alternative connecting assembly for the engine of FIG. 1.

An alternative connecting assembly 45 for connecting the piston to the crankshafts is illustrated in FIG. 13. Assembly 45 differs from assembly 44 in that it includes a third connecting rod 48C rotatably connected to second crank pin 16B and rotatably connected to oscillating member 46 at a fourth connection 47 by a pin 49. The longitudinal axis of pin 49 preferably coincides with the longitudinal axis of pin 60. Fourth connection 47 is thus aligned with third connection 54 such that third connecting rod 48C is arranged in a parallel relationship with second connecting rod 48B.

Assembly 45 further differs from assembly 44 in that oscillating member 46 now includes a pin 51 for further pivotally connecting oscillating member 46 to the piston at a fifth connection (not shown). The longitudinal axis of pin 51 coincides with the longitudinal axis of pin 56 so that oscillating member 46 is connected for pivotal movement about a pivot axis which is perpendicular to and intersects reciprocal axis P, as previously described with reference to FIG. 2. The advantage of connecting assembly 45 is that it further balances the movement of the piston as it reciprocates in the cylinder. Otherwise, the operation and advantages of this embodiment are the same as those described for the preferred embodiment.

Figure 9:
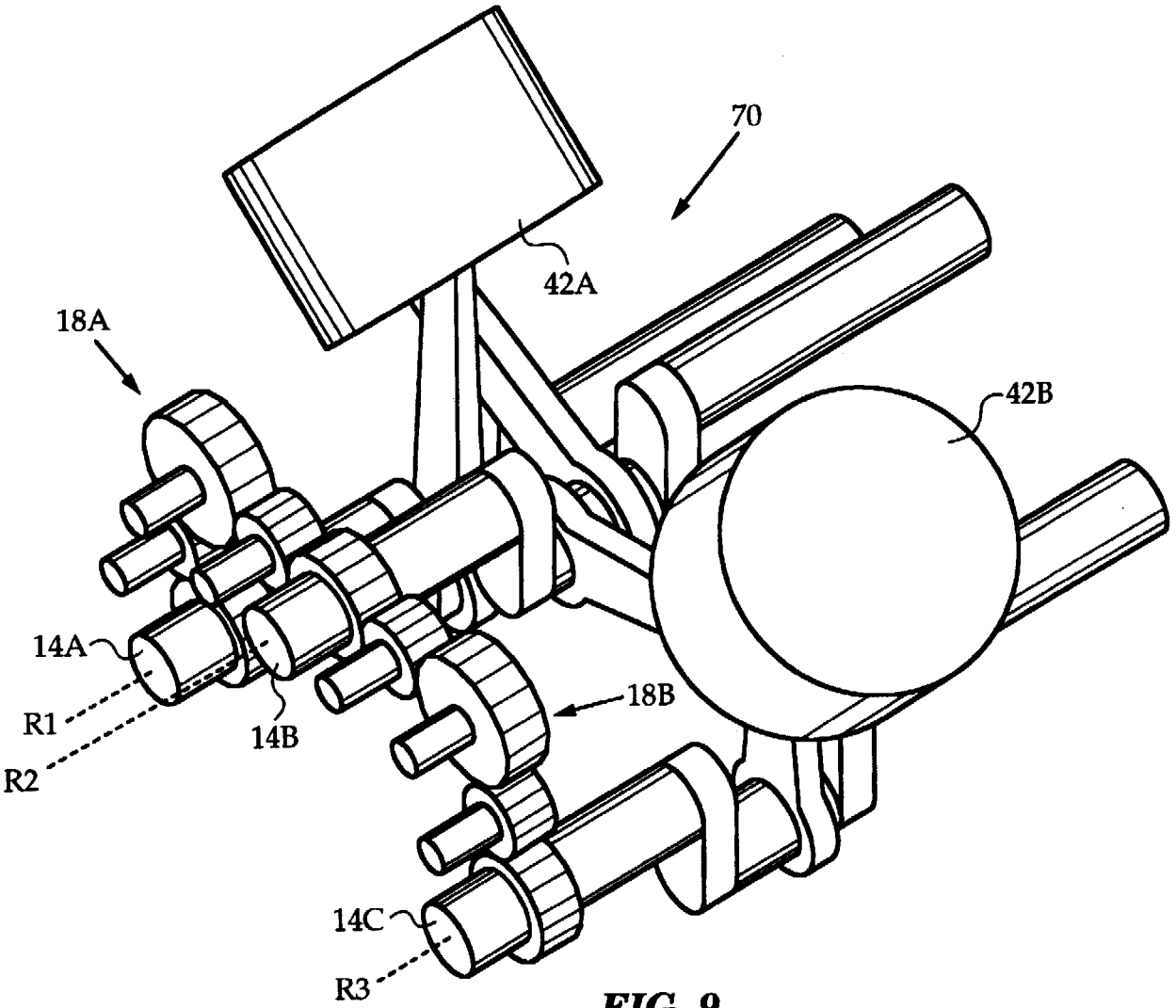
FIG. 9 is a three dimensional view of a triple crankshaft variable stroke engine according to the invention.
Figure 10:
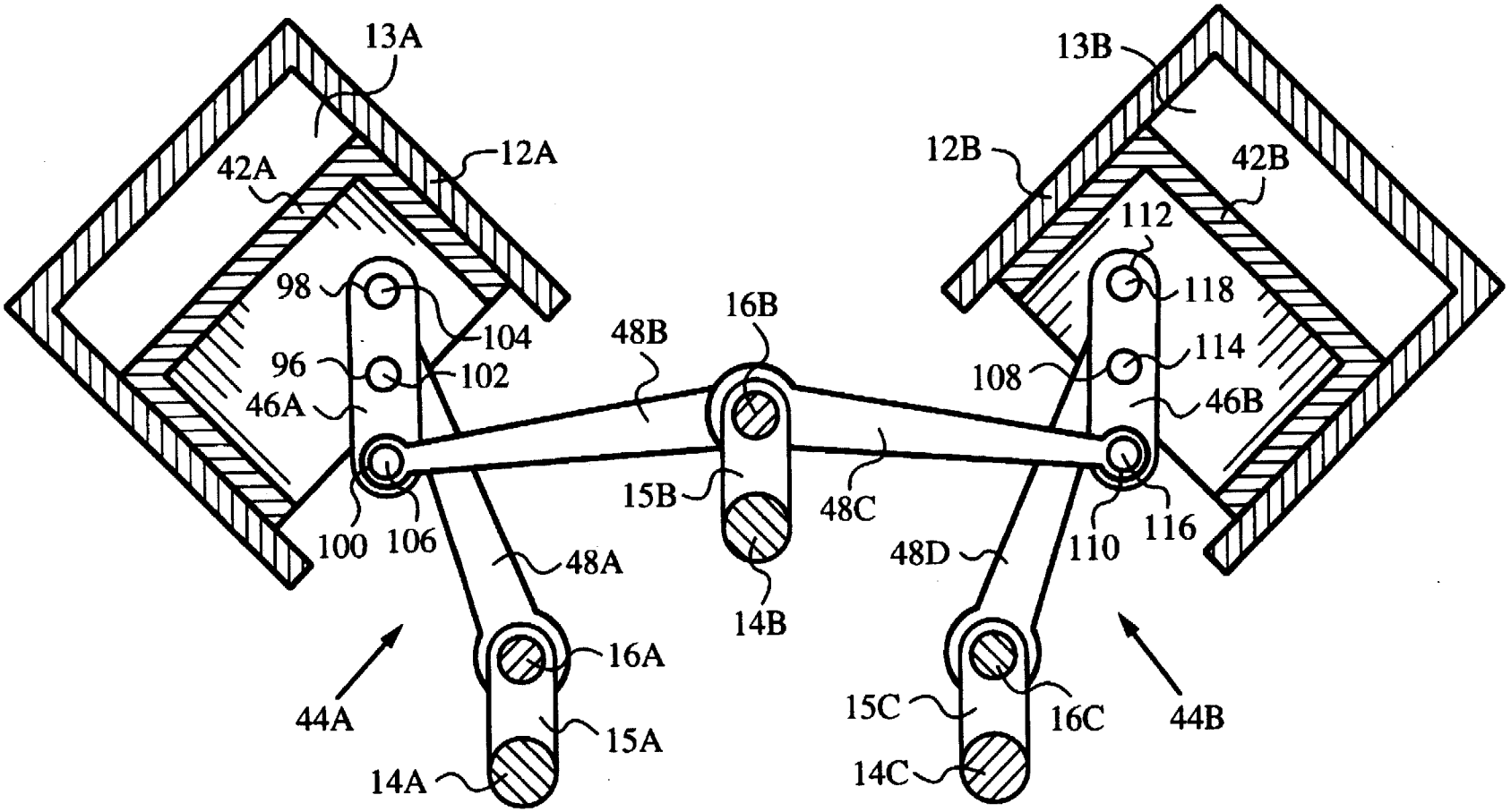
FIG. 10 is a schematic front view of the engine of FIG. 9.
Figure 11:
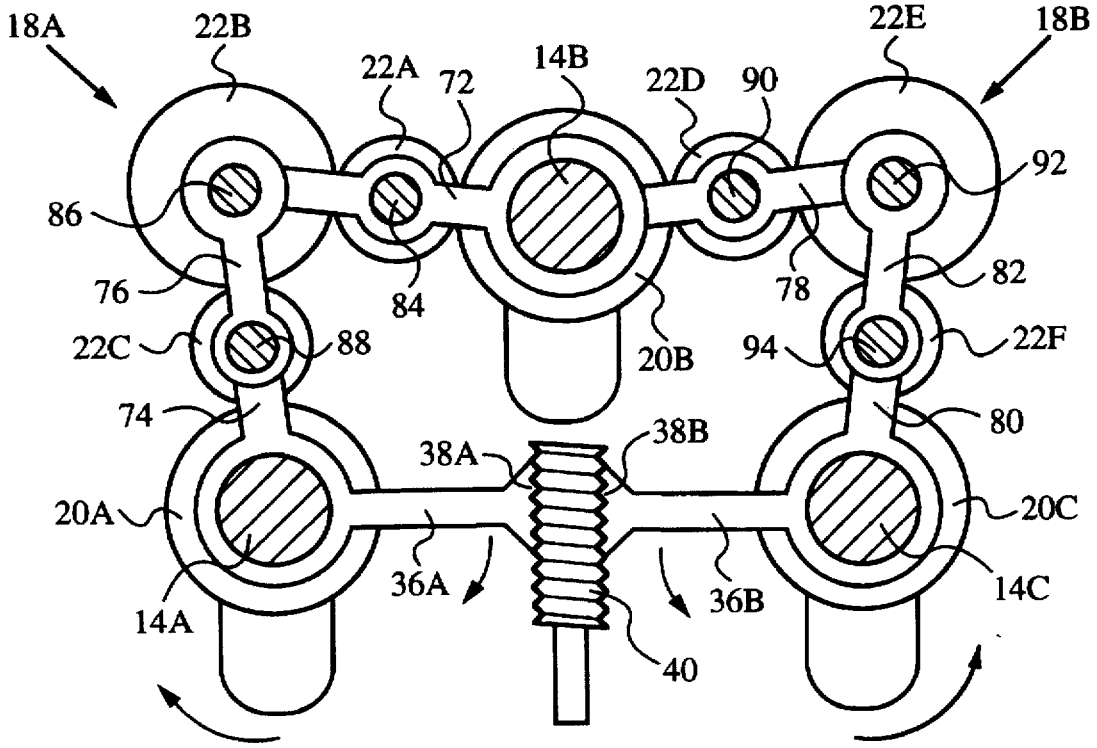
FIGS. 11–12 are schematic front views of synchronizing gears and a phase adjustment mechanism for the engine of FIG. 9.

A second embodiment of the invention is illustrated in FIGS. 9–11. The second embodiment shows how the single cylinder engine of the first embodiment is extended to a V-2 type engine. Because many of the components of the two cylinder engine shown in FIGS. 9–11 are similar to the components of the single cylinder engine shown in FIGS. 1–3, like reference numerals have been used to identify the similar components, with the first component of a pair further identified with the letter "A" and the second component of the pair further identified with the letter "B".

FIG. 9 shows a three dimensional view of a variable stroke engine 70. Engine 70 includes first, second, and third crankshafts 14A, 14B, and 14C mounted for rotational motion about respective first, second, and third rotational axes R1, R2, and R3. Rotational axes R1, R2, and R3 are preferably parallel to each other. Engine 70 further includes a first gear assembly 18A for establishing co-rotation of crankshafts 14A and 14B and for synchronizing a first angular phase relationship $\Phi_1$ between crankshafts 14A and 14B. A second gear assembly 18B establishes co-rotation of crankshafts 14B and 14C and synchronizes a second angular phase relationship $\Phi_2$ between crankshafts 14B and 14C.

FIG. 11 shows a schematic front view of gear assemblies 18A and 18B. Assembly 18A includes a first crank gear 20A mounted coaxially with crankshaft 14A. Crank gear 20A is fixedly attached at its center to crankshaft 14A for mutual rotation of crank gear 20A with crankshaft 14A. Assembly 18A also includes a second crank gear 20B mounted coaxially with crankshaft 14B. Crank gear 20B is fixedly attached at its center to crankshaft 14B for mutual rotation of crank gear 20B with crankshaft 14B. Assembly 18A further includes a first synchronizing gear 22A, a second synchronizing gear 22B, and a third synchronizing gear 22C. Synchronizing gears 22A, 22B, and 22C couple crank gears 20A and 20B.

Assembly 18B includes a third crank gear 20C mounted coaxially with crankshaft 14A. Crank gear 20C is fixedly attached at its center to crankshaft 14C for mutual rotation of crank gear 20C with crankshaft 14C. Assembly 18A also includes a fourth synchronizing gear 22D, a fifth synchronizing gear 22E, and a sixth synchronizing gear 22F. Synchronizing gears 22D, 22E, and 22F couple crank gears 20B and 20C.

A phase adjustment mechanism is connected to gear assemblies 18A and 18B for adjusting first and second angular phase relationships $\Phi_1$ and $\Phi_2$. The phase adjustment mechanism includes a first, second, third, fourth, fifth, and sixth linking members 72, 74, 76, 78, 80, and 82, first and second levers 36A and 36B, and worm gear 40. One end of first linking member 72 is pivotally connected to crankshaft 14B for pivotal movement of member 72 about the rotational axis of crankshaft 14B. Synchronizing gear 22B is rotatably connected to the other end of linking member 72 by a pin 86. A pin 84 rotatably connects synchronizing gear 22A to linking member 72 between crank gear 20B and synchronizing gear 22B such that synchronizing gear 22A couples crank gear 20B and synchronizing gear 22B.

Second linking member 74 is pivotally connected at one end to crankshaft 14A for pivotal movement about the rotational axis of crankshaft 14A. Synchronizing gear 22C is rotatably connected to the other end of linking member 74 by a pin 88 such that synchronizing gear 22C engages crank gear 20A. Third linking member 76 is pivotally connected at one end to first linking member 72 by pin 86. The other end of linking member 76 is pivotally connected to linking member 74 by pin 88. Linking member 76 is designed to hold synchronizing gears 22B and 22C in engagement such that synchronizing gear 22C couples synchronizing gear 22B and crank gear 20A.

One end of fourth linking member 78 is pivotally connected to crankshaft 14B for pivotal movement of member 78 about the rotational axis of crankshaft 14B. Fifth synchronizing gear 22E is rotatably connected to the other end of linking member 78 by a pin 92. A pin 90 rotatably connects fourth synchronizing gear 22D to linking member 78 between crank gear 20B and synchronizing gear 22E such that synchronizing gear 22D couples crank gear 20B and synchronizing gear 22E.

Fifth linking member 80 is pivotally connected at one end to crankshaft 14C for pivotal movement about the rotational axis of crankshaft 14C. Sixth synchronizing gear 22F is rotatably connected to the other end of linking member 80 by a pin 94 such that synchronizing gear 22F engages crank gear 20C. Sixth linking member 82 is pivotally connected at one end to fourth linking member 78 by pin 92. The other end of linking member 82 is pivotally connected to linking member 80 by pin 94. Linking member 82 is designed to hold synchronizing gears 22E and 22F in engagement such that synchronizing gear 22F couples synchronizing gear 22E and crank gear 20C.

Lever 36A, lever 36B, and worm gear 40 provide an actuator for pivoting linking member 74 about the rotational axis of crankshaft 14A and for pivoting linking member 80 about the rotational axis of crankshaft 14C, thereby changing first and second angular phase relationships $\Phi_1$ and $\Phi_2$. First lever 36A has a first end fixably attached to linking member 74 and a second end having first external teeth 38A. Second lever 36B has a first end fixably attached to linking member 80 and a second end having second external teeth 38B. Worm gear 40 is in meshing engagement with external teeth 38A and 38B such that rotation of worm gear 40 pivots the second end of lever 36A about the first end of lever 36A and pivots the second end of lever 36B about the first end of lever 36B.

FIG. 10 shows a schematic front view of the engine with each crank arm 15A, 15B, and 15C in a top dead center position. The engine includes first and second cylinders 12A and 12B which are part of an engine block. Cylinders 12A and 12B are preferably arranged in a V-type relationship with each other. First and second pistons 42A and 42B are slidably mounted for reciprocal linear movement in cylinders 12A and 12B, respectively.

Crankshaft 14A has a first crank arm 15A and a first crank pin 16A connected to crank arm 15A. Crankshaft 14B has a second crank arm 15B and a second crank pin 16B connected to crank arm 15B. Crankshaft 14C has a third crank arm 15C and a third crank pin 16C connected to crank arm 15C. Piston 42A is connected to crank pins 16A and 16B by a first connecting assembly 44A. Piston 42B is connected to crank pins 16B and 16C by a second connecting assembly 44B.

First assembly 44A includes a first oscillating member 46A pivotally connected to piston 42A at a first connection 96 by a pin 102. Assembly 44A also includes a first connecting rod 48A having one end rotatably connected to crank pin 16A. The other end of rod 48A is rotatably connected to oscillating member 46A at a second connection 98 by a pin 104. Assembly 44A further includes a second connecting rod 48B having one end rotatably connected to crank pin 16B. The other end of rod 48B is rotatably connected to oscillating member 46A at a third connection 100 by a pin 106.

Second and third connections 98 and 100 are offset from first connection 96 and offset from each other such that connecting rods 48A and 48B are arranged in a crossing relationship with each other. First connection 96 is preferably centered between second and third connections 98 and 100 such that connections 98 and 100 are positioned equidistantly from connection 96 on opposite sides of connection 96.

Similarly, second assembly 44B includes a second oscillating member 46B pivotally connected to piston 42B at a fourth connection 108 by a pin 114. Assembly 44B also includes a third connecting rod 48C having one end rotatably connected to crank pin 16B. The other end of rod 48C is rotatably connected to oscillating member 46B at a fifth connection 110 by a pin 116. Assembly 44B further includes a fourth connecting rod 48D having one end rotatably connected to crank pin 16C. The other end of rod 48D is rotatably connected to oscillating member 46B at a sixth connection 112 by a pin 118.

Fifth and sixth connections 110 and 112 are offset from fourth connection 108 and offset from each other such that connecting rods 48C and 48D are arranged in a crossing relationship with each other. Fourth connection 108 is preferably centered between fifth and sixth connections 110 and 112 such that connections 110 and 112 are positioned equidistantly from connection 108 on opposite sides of connection 108.

Cylinder 12A and piston 42A define a cylinder chamber 13A. Similarly, cylinder 12B and piston 42B define a cylinder chamber 13B. Engine 70 is preferably an internal combustion engine with each chamber 13A and 13B adapted to receive a combustible mixture of fuel for the combustion thereof. Alternatively, engine 70 may be a pneumatic type engine which converts energy from compressed gas inside each chamber 13A and 13B into rotational motion of crankshafts 14A, 14B, and 14C.

The operation of the second embodiment is analogous to the operation of the preferred embodiment. Referring to FIG. 10, pistons 42A and 42B reciprocate in cylinders 12A and 12B, respectively, in the same manner as is described for the single piston of the preferred embodiment. Pistons 42A and 42B are preferably 90 out of phase as they reciprocate in cylinders 12A and 12B. The primary difference in the operation of the second embodiment from the operation of the preferred embodiment is that engine 70 includes three co-rotating crankshafts 14A, 14B, and 14C, with crankshaft 14B acting as a common crankshaft for connecting assemblies 44A and 44B.

Figure 12:
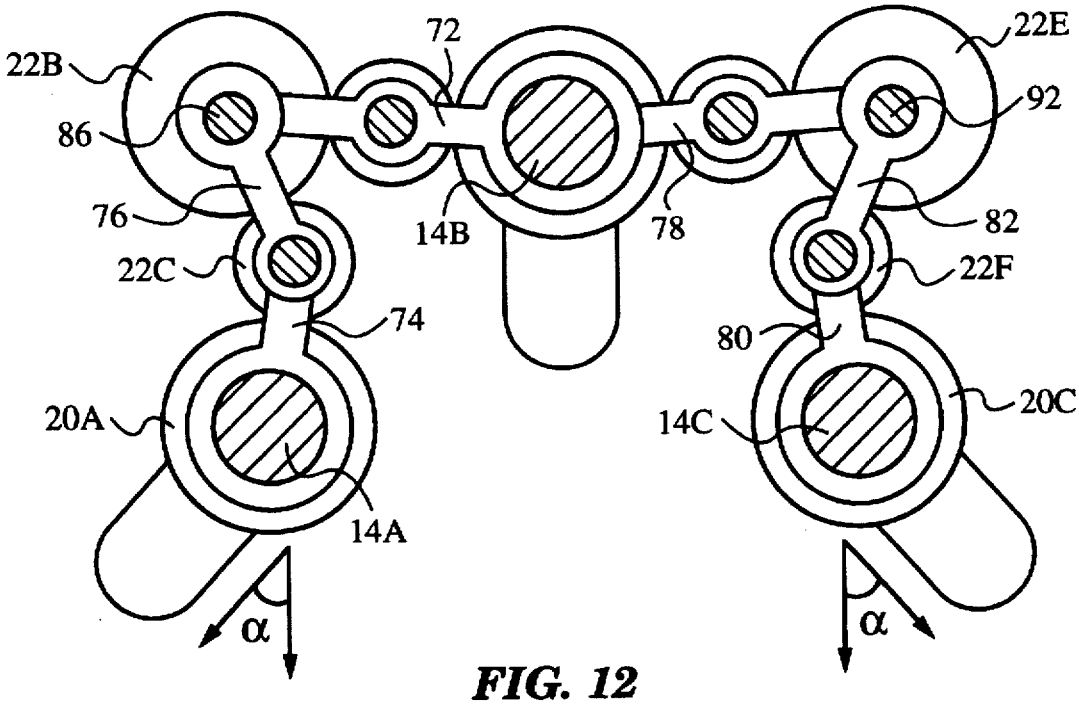

FIGS. 11–12 illustrate how the phase adjustment mechanism adjusts first angular phase relationship $\Phi_1$ between crankshafts 14A and 14B and second angular phase relationship $\Phi_2$ between crankshafts 14B and 14C. Phase relationships $\Phi_1$ and $\Phi_2$ are adjusted by rotating worm gear 40 in a counter clockwise direction, as shown in FIG. 11. Rotation of worm gear 40 causes lever 36A to pivot clockwise, thus pivoting second linking member 74 in a clockwise direction about the rotational axis of crankshaft 14A. Rotation of worm gear 40 also causes lever 36B to pivot counter clockwise, thus pivoting fifth linking member 80 in a counter clockwise direction about the rotational axis of crankshaft 14C.

Referring to FIG. 12, the pivoting movement of member 74 moves third synchronizing gear 22C in the direction of crankshaft 14B. As gear 22C moves, first linking member 72 pivots counter clockwise about the rotational axis of crankshaft 14B and third linking member 76 pivots counter clockwise about pin 86 to hold third synchronizing gear 22C in engagement with second synchronizing gear 22B. The engagement of third synchronizing gear 22C with second synchronizing gear 22B and with first crank gear 20A causes third synchronizing gear 22C to rotate in a counter clockwise direction and crank gear 20A to rotate in a clockwise direction, thus changing phase relationship $\Phi_1$ between crankshafts 14A and 14B by phase angle $\alpha$.

Similarly, the pivoting movement of member 80 moves sixth synchronizing gear 22F in the direction of crankshaft 14B. As gear 22F moves, fourth linking member 78 pivots clockwise about the rotational axis of crankshaft 14B and sixth linking member 82 pivots clockwise about pin 92 to hold sixth synchronizing gear 22F in engagement with fifth synchronizing gear 22E. The engagement of sixth synchronizing gear 22F with fifth synchronizing gear 22E and with third crank gear 20C causes sixth synchronizing gear 22F to rotate in a clockwise direction and crank gear 20C to rotate in a counter clockwise direction, thus changing phase relationship $\Phi_2$ between crankshafts 14B and 14C by phase angle $\alpha$.

The phase adjustment mechanism is preferably adapted to vary each phase relationship $\Phi_1$ and $\Phi_2$ by a phase angle in the range of 0 to 30. The relationship between the phase angle and the amplitude of the reciprocal linear movement of each piston is the same as the relationship described in the preferred embodiment above. As with the single cylinder engine, the operation of the two cylinder engine may also be reversed, so that the two cylinder engine converts rotational motion of the three crankshafts into compressed gas inside each cylinder. Other than the differences described, the operation and advantages of the second embodiment are the same as those in the preferred embodiment above.

Figure 14:
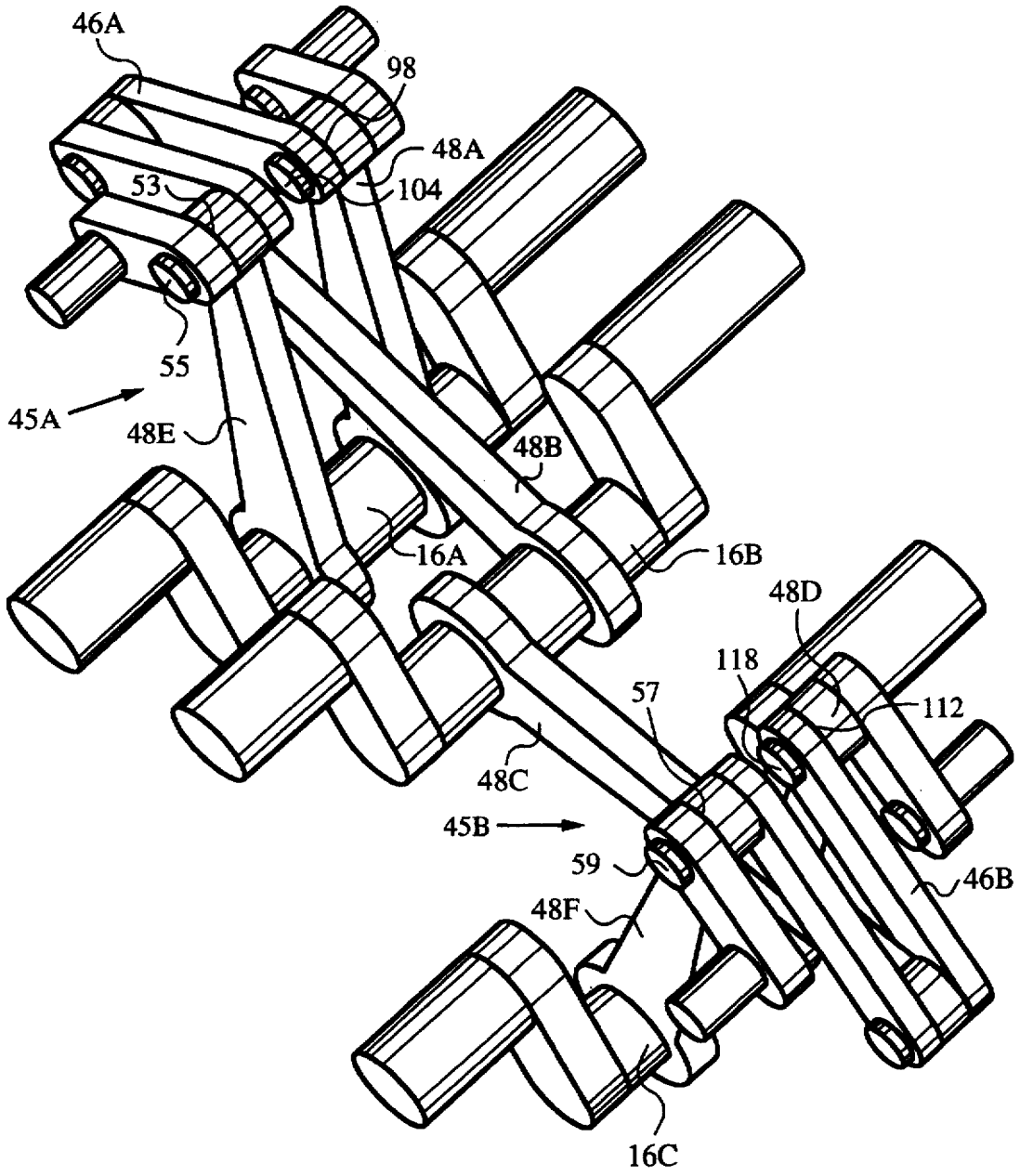
FIG. 14 is a three dimensional view of an alternative connecting assembly for the engine of FIG. 9.

FIG. 14 illustrates two alternative connecting assemblies and 45B for engine 70. Assemblies 45A and 45B are each similar to connecting assembly 45 previously described with reference to FIG. 13. Assembly 45A differs from assembly 44A in that assembly 45A includes a fifth connecting rod 48B rotatably connected to first crank pin 16A and rotatably connected to first oscillating member 46A at a seventh connection 53 by a pin 55. The longitudinal axis of pin 55 preferably coincides with the longitudinal axis of pin 104. Seventh connection 53 is thus aligned with second connection 98 such that fifth connecting rod 48E is arranged in a parallel relationship with first connecting rod 48A.

Similarly, connecting assembly 45B differs from connecting assembly 44B in that assembly 45B further includes a sixth connecting rod 48F rotatably connected to third crank pin 16C and rotatably connected to second oscillating member 46B at an eighth connection 57 by a pin 59. The longitudinal axis of pin 59 preferably coincides with the longitudinal axis of pin 118. Eighth connection 57 is thus aligned with sixth connection 112 such than sixth connecting rod 48F is arranged in a parallel relationship with fourth connecting rod 48D. The advantage of connecting assemblies 45A and 45B is that they further balance the movement of the pistons as the pistons reciprocate in their respective cylinders. Otherwise, the operation and advantages of this embodiment are the same as those described in the second embodiment above.

SUMMARY, RAMIFICATIONS, AND SCOPE

Although the above description includes many specificities, these should not be construed as limitations on the scope of the invention, but merely as illustrations of some of the presently preferred embodiments. Many other embodiments of the invention are possible. For example, the gear assembly and phase adjustment mechanism illustrated represent the presently preferred arrangement for synchronizing and adjusting the angular phase relationship between the crankshafts. However, alternative embodiments may include a belt and pulley system, a chain and sprocket systems, or a differential gear train for synchronizing and adjusting the angular phase relationship between the crankshafts.

For simplicity of understanding, the variable stroke engine of the present invention is described in single cylinder and two cylinder embodiments. However, it is obvious that alternative embodiments may include multiple cylinder in-line engines, as well as V-4, V-6, V-8, and V-12 engines. Additionally, the ratios of distances, amplitudes, and compression described in the preferred embodiment are merely examples of some of the presently preferred ratios. The actual ratios used in any particular implementation of the engine may be tailored to meet the specific operating requirements of the engine.

Further, the invention is described in relation to variable stroke internal combustion engines. However, internal combustion engines represent just one presently preferred implementation of the connecting assemblies and phase adjustment mechanisms of the present invention. Other types of reciprocating piston engines, such as pumps, gas compressors, impact tools, pneumatic power tools, pneumatic power drive components, pneumatic actuators, or any other machinery requiring variable reciprocating linear motion for positioning, translating, actuating, or compressing, are also within the scope of the present invention.

Therefore, the scope of the invention should be determined not by the examples given but by the appended claims and their legal equivalents.

What is claimed is:

1. A variable stroke engine comprising:

a) first and second pistons, each said piston being mounted in a respective cylinder for reciprocal linear movement therein;

b) first, second, and third crankshafts mounted in said engine for rotational motion about respective first, second, and third rotational axes, said rotational axes being substantially parallel to each other, said first crankshaft having a first crank pin, said second crankshaft having a second crank pin, and said third crankshaft having a third crank pin;

c) a first connecting assembly for connecting said first piston to said first and second crankshafts, said first connecting assembly comprising:

i) a first oscillating member pivotally connected to said first piston at a first connection; and ii) first and second connecting rods rotatably connected to said first and second crank pins, respectively, and rotatably connected to said first oscillating member at respective second and third connections, said second and third connections being offset from said first connection and offset from each other such that said first and second connecting rods are arranged in a crossing relationship with each other;

d) a second connecting assembly for connecting said second piston to said second and third crankshafts, said second connecting assembly comprising:

i) a second oscillating member pivotally connected to said second piston at a fourth connection; and ii) third and fourth connecting rods rotatably connected to said second and third crank pins, respectively, and rotatably connected to said second oscillating member at respective fifth and sixth connections, said fifth and sixth connections being offset from said fourth connection and offset from each other such that said third and fourth connecting rods are arranged in a crossing relationship with each other;

e) a first synchronizing means for establishing co-rotation of said first and second crankshafts and for synchronizing a first angular phase relationship between said first and second crankshafts;

f) a second synchronizing means for establishing co-rotation of said second and third crankshafts and for synchronizing a second angular phase relationship between said second and third crankshafts; and g) an adjustment means connected to said first and second synchronizing means for adjusting said first and second angular phase relationships, thereby varying the amplitude of the reciprocal linear movement of each said piston.

2. The engine of claim 1, wherein said first and second synchronizing means comprise:

a) first, second, and third crank gears mounted coaxially with said first, second, and third crankshafts, respectively, each said crank gear being adapted for mutual rotation with its respective crankshaft;

b) first, second, and third synchronizing gears coupling said first and second crank gears; and c) fourth, fifth, and sixth synchronizing gears coupling said second and third crank gears;

and wherein said adjustment means comprises:

a) a first linking member pivotally connected to said second crankshaft for pivotal movement about said second rotational axis, said first and second synchronizing gears being rotatably connected to said first linking member such that said first synchronizing gear couples said second crank gear and said second synchronizing gear;

b) a second linking member pivotally connected to said first crankshaft for pivotal movement about said first rotational axis, said third synchronizing gear being rotatably connected to said second linking member such than said third synchronizing gear engages said first crank gear;

c) a third linking member pivotally connected to said first and second linking members, said third linking member holding said second and third synchronizing gears in engagement such that said third synchronizing gear couples said second synchronizing gear and said first crank gear;

d) a fourth linking member pivotally connected to said second crankshaft for pivotal movement about said second rotational axis, said fourth and fifth synchronizing gears being rotatably connected to said fourth linking member such that said fourth synchronizing gear couples said second crank gear and said fifth synchronizing gear;

e) a fifth linking member pivotally connected to said third crankshaft for pivotal movement about said third rotational axis, said sixth synchronizing gear being rotatably connected to said fifth linking member such that said sixth synchronizing gear engages said third crank gear;

f) a sixth linking member pivotally connected to said fourth and fifth linking members, said sixth linking member holding said fifth and sixth synchronizing gears in engagement such that said sixth synchronizing gear couples said fifth synchronizing gear and said third crank gear; and g) an actuating means for pivoting said second linking member about said first rotational axis and for pivoting said fifth linking member about said third rotational axis, thereby changing said first and second angular phase relationships.

3. The engine of claim 2, wherein said actuating means comprises:

a) a first lever for pivoting said second linking member about said first rotational axis, said first lever having first and second ends, said first end of said first lever being fixably attached to said second linking member and said second end of said first lever including first external teeth;

b) a second lever for pivoting said fifth linking member about said third rotational axis, said second lever having first and second ends, said first end of said second lever being fixably attached to said fifth linking member and said second end of said second lever including second external teeth; and c) a worm gear in meshing engagement with said first and second external teeth for pivoting said second end of said first lever about said first end of said first lever and for pivoting said second end of said second lever about said first end of said second lever.

4. The engine of claim 1, wherein said first connecting assembly further comprises a fifth connecting rod rotatably connected to said first crank pin and rotatably connected to said first oscillating member at a seventh connection, said seventh connection being aligned with said second connection such that said fifth connecting rod is arranged in a substantially parallel relationship with said first connecting rod.

5. The engine of claim 1, wherein said second connecting assembly further comprises a sixth connecting rod rotatably connected to said third crank pin and rotatably connected to said second oscillating member at an eighth connection, said eighth connection being aligned with said sixth connection such that said sixth connecting rod is arranged in a substantially parallel relationship with said fourth connecting rod.

6. The engine of claim 1, wherein said adjustment means is adapted to vary each said angular phase relationship by a phase angle in the range of 0 to 30, thereby varying the amplitude of the reciprocal linear movement of each said piston between a first amplitude A when said phase angle equals 0 and a second amplitude B when said phase angle equals 30, the ratio A:B being substantially equal to 4:4.65.

7. The engine of claim 1, wherein said engine is an internal combustion engine.

8. The engine of claim 1, wherein said engine is of the type which converts energy from compressed gas in each said cylinder into the rotational motion of said crankshafts.

9. The engine of claim 1, wherein said engine is of the type which converts the rotational motion of said crankshafts into compressed gas inside each said cylinder.

* * * * *